US005335755A

United States Patent [19]

Miller

[11] Patent Number: 5,335,755

[45] Date of Patent: Aug. 9, 1994

[54] FAIL-SAFE LOAD SUPPORT SYSTEM

[76] Inventor: Harry Miller, 5136 N. 68th Pl., Scottsdale, Ariz. 85253-7007

[21] Appl. No.: 159,368

[22] Filed: Nov. 30, 1993

[51] Int. Cl.[5] ..... B60S 13/00

[52] U.S. Cl. ..... 187/8.77; 414/229; 414/249

[58] Field of Search ..... 187/8.41, 8.77, 8.62; 414/229, 233, 249, 242; 254/2 R, 5 R, 5 C, 89 R, 91

[56] References Cited

U.S. PATENT DOCUMENTS 3,941,257 3/1976 Matsuura ..... 187/8.77

4,551,054 11/1985 Klaus ..... 414/229

FOREIGN PATENT DOCUMENTS 221566 9/1990 Japan ..... 414/229

*Primary Examiner*—Kenneth W. Noland

[57] ABSTRACT

A structural support system for vehicle storage has two independent means to rotate a two-deck inclinable structure about a pivot on a stationary structure. The inclinable structure does not change shape when it is tilted and contains a compression member which connects the upper and lower decks. Four tension members are provided to connect the bottom of the compression member with the four corners of the upper deck. A force sensor is used to calibrate the forces in the tension rods to constrain the compression member from deflecting when the decks are loaded, enabling a significant increase in the safe dynamic load carrying capability of the inclinable structure. The system includes an automatic vehicle restraining mechanism to prevent movement of the vehicle when inclined away from horizontal. A secondary cable system operates in parallel with the primary rotation means to counteract the empty weight of the inclinable structure.

5 Claims, 5 Drawing Sheets

FAIL-SAFE LOAD SUPPORT SYSTEM

BACKGROUND OF THE INVENTION

1. Field of the Invention

This invention relates to a load support system for an inclinable structure consisting of two decks which are used to store a vehicle on each deck. The inclinable structure is supported by a fixed axle on one side and two independent cable or hydraulic actuator systems on the other side, enabling the structure to be positioned for vehicle access to either deck.

2. Description of Prior Art

Typical characteristics of prior two-deck inclinable structures are described in U.S. Pat. Nos. 4,486,140, 4,316,527, 3,9840,11, 3,941,257, 3,924,760, 3,786,940, 3,712,485, 3,520,423 and 3,493,129. These structures change shape as they tilt. U.S. Pat. No. 3,520,423 discloses an inclinable structure consisting of two decks which are constrained to move in a parallelogram geometric configuration. Each deck has provisions to store a vehicle. The forces which move the decks plus the stored vehicles are derived from a single hydraulic actuator which, in turn, operates two independent cables which are attached to two locations on one of the decks. This results in a distribution of reaction forces at the two cable attachments and the fixed axle bearings. Thus, each cable supports one fourth ($\frac{1}{4}$) of the total weight including the empty weight of the inclinable structure plus the combined weight of both vehicles. Should one of the cables fail, however, the surviving cable system is required to support one half ($\frac{1}{2}$) of the total weight including the weight of the vehicles. Since the empty weight of the structure is a constant, the impact of a cable failure is considerable with regard to the fail-safe vehicle load capacity of the inclinable structure. A similar situation occurs with U.S. Pat. No. 3,941,247 where the forces required to move the structure are supplied by a single electric motor which operates two independent chain drive systems. Here again, failure of one of the chain drives will result in a doubling of the forces on the surviving chain drive. In the case of U.S. Pat. No. 4,486,140, two independent hydraulic actuators are used to obtain fail-safe characteristics. If one of the actuators should fail, the surviving hydraulic system must produce twice the load-carrying capacity it normally supplies. Another disadvantage of the prior art two-deck configurations is the complex linkages required to change the shape of the inclinable structure as it changes position.

A characteristic of the inclinable vehicle storage structures is the requirement to restrain the vehicles from moving when the storage decks are inclined away from horizontal. U.S. Pat. Nos. 3,493,129, 3,520,423 and 3,941,257 recognize the need to prevent movement of a stored vehicle while the structure transitions from one position to other operational positions. This need is met by requiring the vehicle driver to maneuver the front wheels of the vehicle into a depressed wheel well. In the case of Japan document 0192963, the driver is required to feel the automobile climb a ramp and subsequently feel that the wheel has been lowered to its operational position for the device to be effective. A particular disadvantage of the devices used is the extra engine effort required to exit the wheel well. The devices described in U.S. Pat. Nos. 3,493,129, 3,520,423, 3,941,257 and Japan document 0192963 will be ineffective and unsafe if the vehicle driver does not maneuver the vehicle into the wheel well which restrains movement of the vehicle.

SUMMARY OF THE INVENTION

This invention covers three fundamental objectives. The first objective is to quadruple the maximum load that can be safely carried by a deck having a given span between the axle and the lifting cables or hydraulic actuators. The second objective is to relieve the primary lifting systems from having to lift the empty weight of the inclinable structure. The third objective is to provide driver guidance to safely and smoothly enter an inclined deck to a position where the vehicle is automatically constrained from moving in either direction without requiring the driver to rely on the manual feel of uneven driving surfaces.

The invention utilizes a stationary structure which supports a two-bearing axle and lifting machinery which rotates a rigid two-deck structure about the fixed axle. Key structural elements of the inclinable structure are a sturdy compression member which connects the center of the upper deck span with the center of the lower deck span and four tension rods which connect the bottom of the compression member to the four corners of the upper deck. Two of the corners of the upper deck bear directly on the axle bearings. The other two corners of the upper deck are directly connected to the lifting machinery. The compression member-tension rod configuration results in a rigid structure which does not change shape as it tilts. The following discussion refers to material in the Carnegie Steel Company Manual, titled "Information and Tables pertaining to Structural Steel". Reference is made to pages 159, 160, 166 and 169 of the manual, where data is presented for beams under various loading conditions. Case 1, page 159, covers beams supported at the ends of the span under a uniform load which corresponds to the distributed weight of the empty deck. Case 18, page 166, covers beams supported at the ends of the span with a single concentrated load at the center of the span corresponding to the load of one pair of vehicle wheels. Case 24, page 169, covers two concentrated loads each due to a pair of vehicle wheels.

The combination of the central compression member and the four tension rods constrains the centers of the upper and lower deck spans from deflecting under load. This creates two spans each of which is one half ($\frac{1}{2}$) the length of the full span of the deck. In accordance with cases 1 and 24 of the Carnegie Manual, the maximum load that can be supported by a beam when the compression member is not present is directly proportional to the allowable stress and the section modulus of the beam and inversely proportional to the full span of the deck. That is, the greater the span, the less load it can support for a specified stress and beam section modulus. When the compression member and tension rods are enstaffed, the full span of the decks is divided into two smaller spans, each one half ($\frac{1}{2}$) the length of the full deck span. Since the maximum loads that can be supported by a given span is inversely proportional to the length of the span, each of the smaller spans can support twice the allowable load on the larger span, resulting in a quadrupling of the load that can be supported by the entire deck, compared to the situation where the central compression member and tension rods are not installed. The successful application of the compression member-tension rod configuration requires an accurate adjustment of the tension in the rods when the structure is subjected to a known load. This adjustment is accomplished through turnbuckles provided on each tension rod and a calibration procedure which utilizes a force sensor mounted on each tension rod during the calibration procedure. The calibration procedure is accomplished at a time when the empty weight of the inclinable structure is the only load on the structure. This weight is accurately known. The geometric relationship of the tension rods to the parallel decks is also known. This allows a calculation to be made for the value of the tension force in each rod. The force sensors are attached at a time when there is no tension in the rods. The turnbuckles are then successively adjusted until the force sensors all read the calculated tension for the known empty weight of the inclinable structure.

The result of a failure of one of the two independent lifting cables with respect to the fail-safe vehicle load carrying capacity of the structure is significantly improved if the surviving lifting cable system is relieved from having to move the constant empty weight of the inclinable structure. This is achieved by a secondary cable system which is attached to a counterweight equal to one quarter (¼) the weight of the empty inclinable structure. The secondary cable system operates in parallel with the primary lifting cable system. In the event of failure of one of the primary lifting cables, two of the connecting rods which are normally under tension automatically change to compression and the other two rods are subjected to an increased tension.

This invention guides a vehicle driver to enter an inclined storage deck to a position where one of the front wheels is automatically captured by a mechanism which constrains the vehicle from moving in either direction without requiring the driver to rely on the manual feel of uneven driving surfaces. Guidance is provided in the form of a set of green, amber and red lights located in the normal field of view of the driver. A green light indicates that the driver should continue to move along the inclined deck until the light changes to amber, at which time the driver should slow the movement of the vehicle. The appearance of the amber light indicates that the wheel constraint mechanism is starting its operating cycle. In a few seconds the constraint procedure will be finished and a red light will illuminate, providing a positive indication that the vehicle is securely constrained from moving in either direction. In order to reverse the procedure, the driver will operate a push button that is accessible to the driver from his normal operating position. This action will retract the wheel constraint device, enabling the driver to exit the inclined deck smoothly and without hindrance. Complete retraction will be indicated by a light change from red to green. It should be noted that the logic which operates the red light can also be used to provide an indication to a remote location that a specific vehicle space is occupied.

BRIEF DESCRIPTION OF THE DRAWINGS

The description of the preferred embodiment refers to parts of the structure as left, right, front, rear, upper, lower.

FIG. 2 is the partial plan view of the front side of the structure. FIG. 3 is the partial plan view of the rear side. The right side of the structure is depicted on the right side of the figures. The left side of the structure is depicted on the left side of the figures.

DESCRIPTION OF THE PREFERRED EMBODIMENT

The fail-safe load support system can best be described by referencing a specific structural configuration. It should be understood that the application of the techniques to be described does not limit the general scope of the invention.

Figure 1:
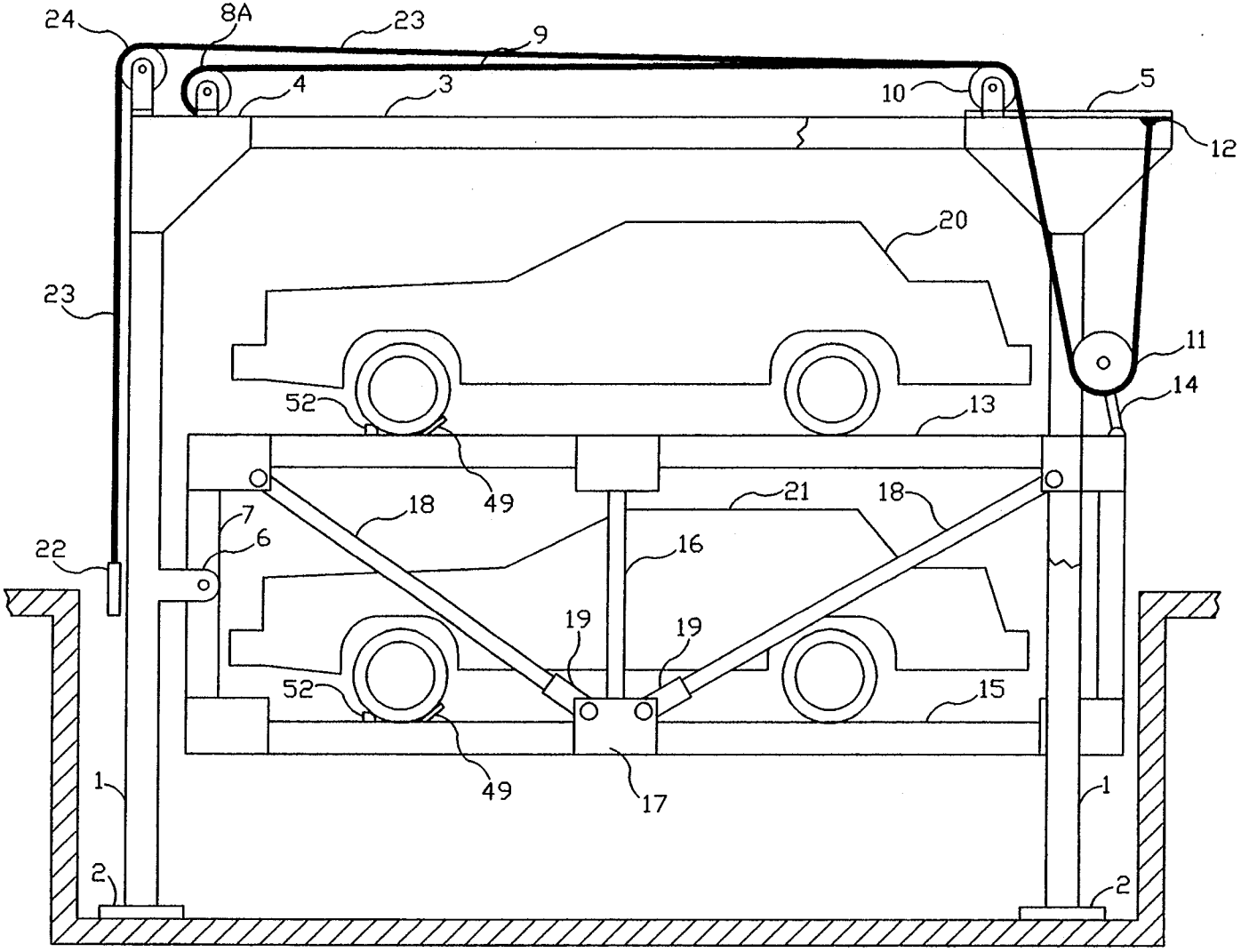
FIG. 1 is a left side view of the structure in a horizontal position. A mirror image of FIG. 1 reflects the right side of the structure. The front side of the structure is that side which supports the fixed axle. The rear side of the structure contains the attachments of the lifting cable systems. The cross-hatched depiction represents the ground which is the ultimate support of the stationary as well as the moving parts of the entire structure.

FIG. 1 illustrates a structure consisting of a four column stationary structure 1 fixed to the ground through four base plates 2, two on the left side of the structure and two on the opposite right side. The upper front and upper rear of the stationary structure 1 is tied together by left and right beams 3. The front upper left and front upper right sides of the stationary structure are tied together by platform 4. Platforms 5 are provided at each rear corner of the upper stationary structure 1. The stationary structure 1 also supports two spherical bearings 6; one on the left front and one on the light front of the stationary structure. The two bearings 6 serve as a pivot for the inclinable structure 7. A pair of cable drums 8A and 8B are mounted on the left and right sides of the cable drive platform 4. Each cable drum provides a termination for a cable run 9 on the left and a similar cable run on the right. The cables 9 are guided downward through one of the grooves of the two-groove pulleys 10, which are mounted on the rear left and right platforms 5. The cables 9 are guided through one groove of the two-groove left and right hoist sheaves 1 1 and subsequently guided upward to tie-downs 12 on structure platforms 5. The hoist sheaves 1 1 are connected to the left and right rear corners of the upper deck 13 through a pair of turnbuckles 14. The inclinable structure 7 consists of an upper deck 13 and a lower deck 15. A rectangular frame 16, consisting of four beams welded together at the four corners of the frame, is the principal connection between the upper deck 13 and the lower deck 15. Frame 16 is located midway between the pivot 6 and the rear cable connections to the deck 13 by way of turnbuckles 14.

The bottom of frame 16 is attached to a pair of gussets 17 which are also attached to the lower deck 15; one on the left side of the lower deck, the other on the right side. Four rods 18, comprising two rods on the left side of the structure 7 and two rods on the right side of the structure, connect the gussets 17 to the four corners of the upper deck 13. A calibration procedure, to be described, is used to adjust the tension in each rod 18 by means of turnbuckles 19 to ensure that the centers of the decks 13 and 15 do not deflect when subjected to the empty weight of the tiltable structure 7 plus the weights of the vehicles 20 and 2 1. As discussed in the summary, this results in an increase in the load carrying capability of the two decks by a factor of four. A counterweight 22, equal to one quarter (¼) of the empty weight of the inclinable structure 7 is supported by left and right cables 23 and travels vertically in front of the stationary structure 1. The cables 23 are guided rearward by left and right single-groove pulleys 24 which aresupported by platform 4. The cables 23 form a secondary cable lift system when they are guided through the second groove of pulleys 10 and the second groove of hoist sheaves 11, thus relieving the primary lift cables 9 from the empty load of the inclinable structure 7. It should be noted that the load on each turnbuckle 14 is double that of the sum of the loads on the primary and secondary cables 9 and 23 by virtue of the cable return loops from the hoist sheaves 11 to the tie-downs 12 on platforms 5.

Figures 2, 3:
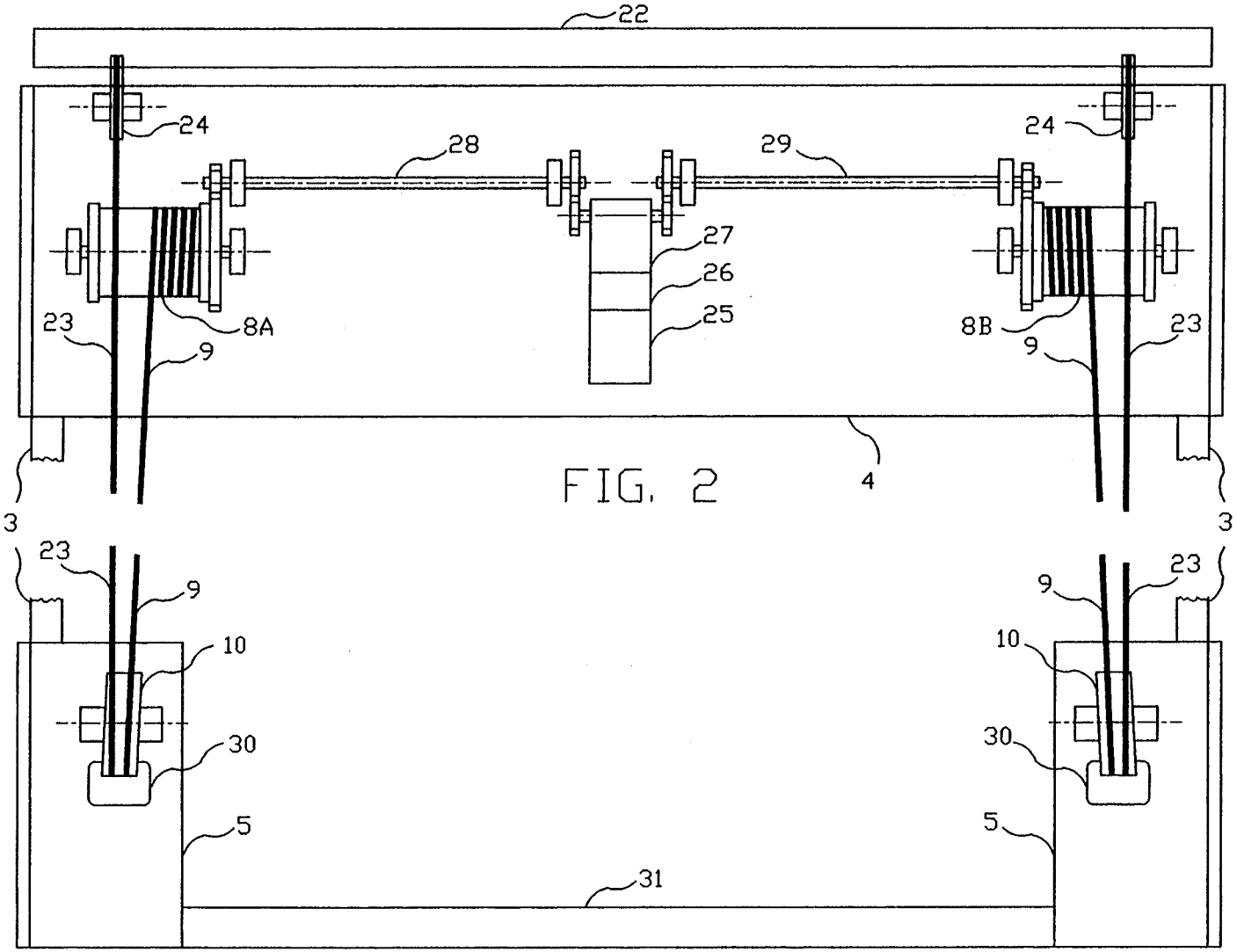
FIGS. 2 and 3 are partial plan views of the upper stationary structure which supports the lifting machinery.

FIG. 2 is a plan view of the upper front part of the stationary structure 1, showing the cable lifting machinery mounted on platform 4. The left cable drum 8A is similar to the right cable drum 8B except that one has left hand spiral grooves while the other has right hand spiral grooves. The left and right cable runs 9, which terminate on drums 8A and 8B, are independent. The cable drums 8A and 8B are driven simultaneously by means of electric motor 25 through power-off brake 26 and double-output shaft gear reducer 27. The left drum 8A is geared to the left output shaft of gear reducer 27 through transmission 28. The right drum 8B is similarly geared to the right output shaft of gear reducer 27 through transmission 29. If either the left or right cable runs 9 should fail, the surviving cable run continues to operate properly in a fail-safe manner. The counterweight 27 is suspended by a pair of cables 23, one on the left and another on the right. The counterweight 22 moves vertically in front of platform 4. The suspension cables 23 change direction by means of single-groove pulleys 24 mounted on the left and right sides of platform 4.

FIG. 3 is a plan view of the upper rear part of the stationary structure 1, illustrating the continuation of left and right cable runs 9 and 23 before they are guided downward through holes 30 in platforms 5 to the two-groove hoist sheaves 1 1, FIG. 1. Cables 9 and 23 are individually nested into the left and right two-groove pulleys 10, mounted on platforms 5. Beam 31 connects the left and right rear ends of side beams 3. Beams 31 and 3 serve as supports for platforms S.

Figures 4, 5, 6:
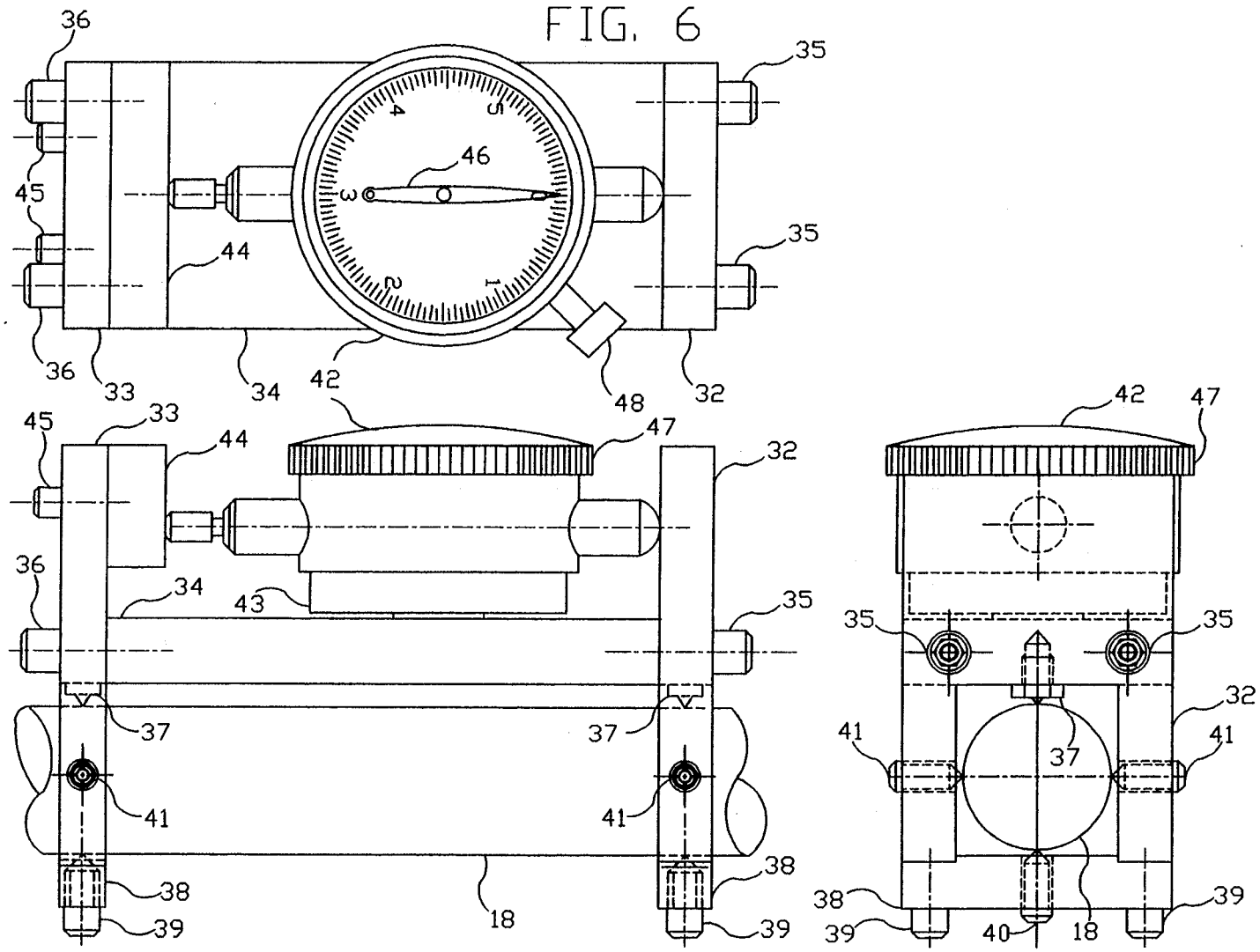
FIGS. 4, 5 and 6 are three orthogonal views of the force sensor used in the calibration procedure.

One half (½) of the vertical forces on the two bearings 6 and the two hoist sheave turnbuckles 14 is contributed by the vertical components of the tensions that exist on the specific tension rods 18 that are linked with the specific bearings and turnbuckles. During normal operation it is desirable that the total weight of the inclinable structure be equally distributed to the four corners of the upper deck 13. This will require a calibration procedure which measures the tension in the rods under a known load and adjustment of the turnbuckles 19 until the vertical components of the tensions are each equal to one eighth (⅛) of the known load at a time when the inclinable structure is horizontal. The rod tension which has a specific vertical component is equal to the desired vertical component divided by the sine of the angle between the tension rod and the lower deck 15. For example, if the desired vertical component of the tension is 1500 pounds and the rod angle is 32 degrees, the tension in each rod should be 2830 pounds. The key device in the calibration procedure is the force sensor, three views of which are shown in FIGS. 4, 5, 6. FIG. 4 is a top view of the sensor; FIG. 5 is a side view of the sensor; FIG. 6 is a front view of the sensor. The basic operational principle of the sensor is its capability to accurately measure the stretch of the tension rod between two points on the rod when the rod is subjected to tension and thus determine the force on the rod based on the known cross-sectional area of the rod and the known modulus of elasticity of the rod material. The mathematical basis for a specific application is summarized in the following discussion.

The sensitivity of the sensor is set at a value which is consistent with the desired range of forces to be measured. Assume this range to be zero to 10,000 pounds with a resolution of 100 pounds. A commercially available dial indicator that is suitable to measure the stretch in the rod is Starrett No 656-109. This indicator has a single revolution needle movement equivalent to 0.006 inch with major marked graduations of 0.001 inch and minor graduations of 0.00005 inch. Adequate resolution will be obtained if the sensitivity of the force sensor is 2000 pounds per 0.001 inch of stretch. The resolution of the force sensor, based..on minor graduations of 0.00005 inch, will be 100 pounds. An indicator movement of 0.005 inch corresponds to a force measurement of 10,000 pounds.

A rod diameter of 0.875 inch has a cross section area of 0.601 square inch. The rod stress under a load of 10,000 pounds is 16,339 pounds per square inch which is consistent with allowable stress levels for steel rods. The rod strain consistent with a steel modulus of elasticity of 29,000,000 pounds per square inch and a stress of 16,339 pounds per square inch is 0.0005634 inch per inch. To obtain a stretch of 0.005 inch under a rod load of 10,000 pounds requires a zero-load distance of 8.875 inches between stretch points on the rod. The instrument configuration shown in FIGS. 4, 5, 6 is consistent with these parameters. The design of the force sensor is such that the sensor can be attached to a portion of the tension rod 18 after the tension rods have been installed on the inclinable structure 7, FIG. 1. It is essential that the force sensor be attached to the tension rod 18 at a time when the rod is free of load. This condition will occur when the turnbuckles 19 are adjusted so that the rods 18 are completely relaxed. The force sensor configuration prior to its attachment to rod 18 comprises two open yokes 32, 33 which are firmly connected to each other by an accurately dimensioned member 34. Member 34 is attached to top yoke 32 by means of a pair of cap screws 35. Member 34 is temporarily attached to bottom yoke 33 by cap screws 36. Each yoke 32,33 is equipped with a cone-shaped anvil 37 which is accurately located with respect to the surfaces of yokes 32 and 33. The vertical dimension of member 34 is accurately machined to result in a distance of 8.875 inches between top and bottom anvils 37, FIG. 5. Yoke closure caps 38 are attached to yokes 32 and 33 by means of cap screws 39 after the yokes have surrounded rod 18. Each closure cap 38 is equipped with a cone-shaped set screw 40 which is used to seat the yokes 32,33 and closure caps 38 to the rod 18. Additional cone-shaped set screws 41 are provided on the yokes 32,33 to ensure firm grips between the tension rod 18 and the yokes 32, 33.

Dial indicator 42 with magnetic back 43 is attached to member 34 between upper yoke 32 and extension block 44 which is attached to the lower yoke 33 by cap screws 45. The extension block 44 is designed to accommodate the overall length of the dial indicator 42 in a manner which allows freedom of the dial indicator needle 46 to rotate at least one full revolution corresponding to 0.006 inch variation between the positions of yokes 32 and 33. The serrated dial bezel 47 is adjusted so that the needle 46 reads 0.000 inch and then locked in position by clamp 48. The cap screws 36 which temporarily connected the bottom yoke 33 with member 34 are removed after the rod grips have been established and the dial indicator 42 has been installed and zeroed out, allowing the yokes 32 and 33 to move relative to each other and thus measure rod 18 tension at a gradient of 2000 pounds per 0.001 inch of relative yoke movement with a resolution of 100 pounds.

The connecting rods 18, FIG. 1, are normally under tension while functioning to restrain gusset 17, FIG. 1, from deflecting under load. In the event of failure of one of the primary lift cables 9, the connecting rods 18 automatically adjust to counteract the failure. For example, consider that the right primary lift cable 9 fails and it not capable of applying the necessary lift. This is compensated by compression on the right rear connecting rod 18 and an increase in the tension of the right front connecting road. Conversely, the left rear connecting rod is subjected to an increase in tension and the left front connecting rod is subjected to compression, thus transferring the former load on the right rear cable 9 to the left rear cable 9.

Figure 7:
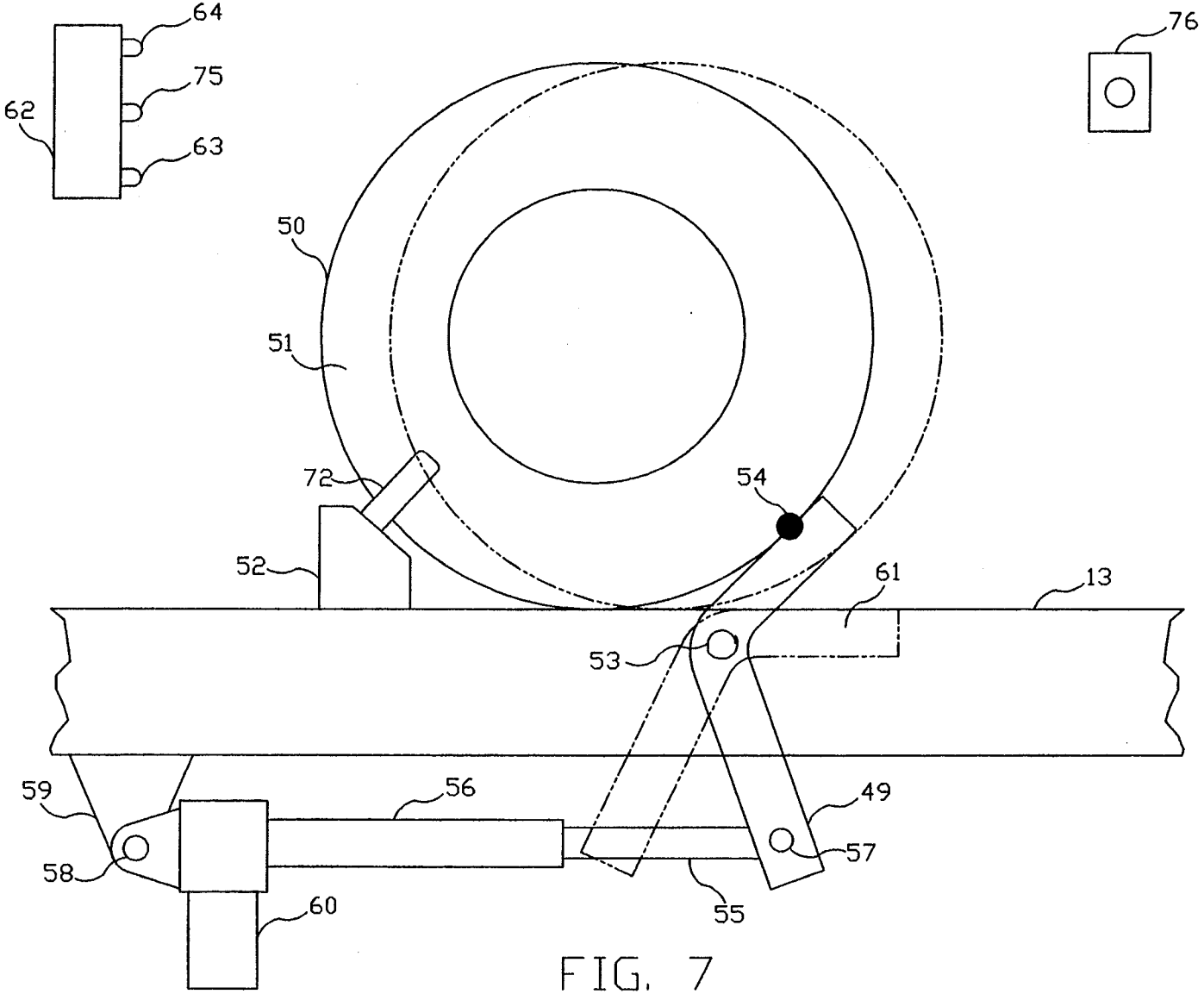
FIG. 7 illustrates the mechanical elements which comprise the vehicle restraint apparatus.

Decks 13 and 15, FIG. 1, can assume various inclined positions with respect to horizontal. A typical inclination is ten degrees (up or down). A 4000 pound vehicle on a 10 degree slope requires a counter force of 695 pounds parallel to the deck to prevent the vehicle from moving due to the weight component along the deck. The movable lever 49, FIG. 1, provides the counter force capability. FIG. 7 elaborates on the front wheel restraint apparatus. The solid line depiction shown in FIG. 7 illustrates the wheel restraint apparatus in its constrained position. The dotted line depiction shown in FIG. 7 illustrates the apparatus in its dormant condition; that is, when it is ready to accept occupancy by an approaching vehicle. The solid line position of the front wheel 50 and associated tire 51, shown in FIG. 7, is restrained from moving in either direction by front barrier 52 which is fixed to the deck 13 and a movable lever 49, rotating about pivot 53 which is also fixed to the deck. In the typical situation shown in FIG. 7, the angle of lever 49 relative to deck 13 when in contact with wheel tire 51 at point 54 is 45 degrees. This angle requires a normal force of 982 pounds at tire contact point 54 to restrain a 4000 pound vehicle on a 10 degree upward slope. The effort required to exert a force at point 54 is supplied by extensible shaft 55 of linear actuator 56 at lever pivot 57. The actuator 56 is suspended between pivots 57 and 58. Pivot 58 is fixed to deck 13 by bracket 59. The actuator package 56 consists of an electric motor, brake, gearing and a screw-nut assembly which positions the extensible shaft 55. The actuator 56 is also equipped with adjustable limit switches which can be set to stop and brake the motion of the extensible shaft 55 at specific points of travel in either direction. The limit switches are set to allow movement of the extensible shaft 55 to result in a 45 degree rotation of restraint lever 49, thus enabling the restraint lever to assume a position 61 which is flush with the deck 13 when the extensible shaft 55 is retracted and a 45 degree inclination to deck 13 when shaft 55 is fully extended. Whenever the restraint lever 49 is flush with the deck surface 13, the light assembly 62 will illuminate the green light 63. When the lever 49 assumes its 45 degree position, the red light 64 will illuminate on light assembly 62, indicating that wheel 50 is restrained from moving in either direction and that the vehicle space on deck 13 is occupied.

Figure 8:
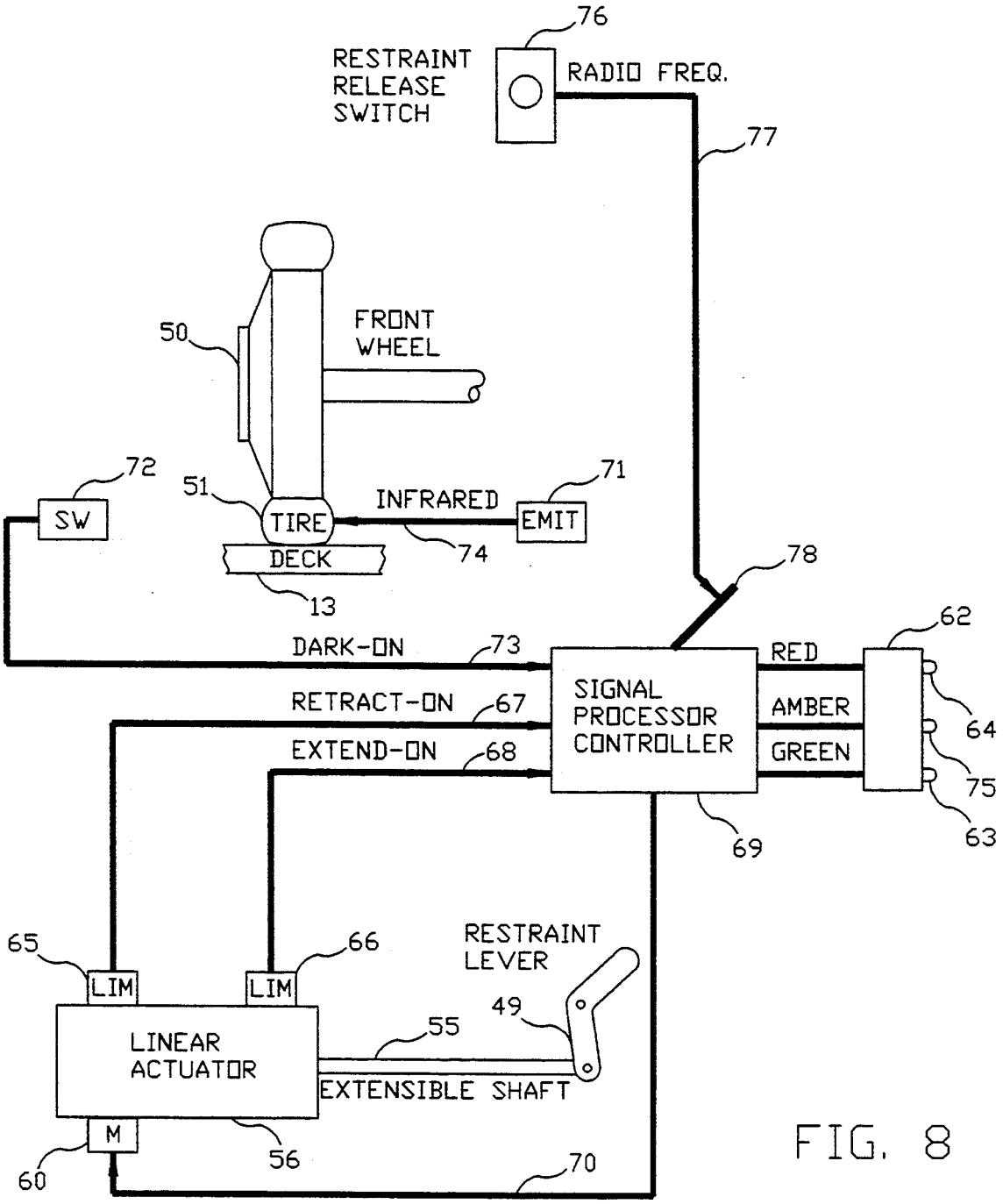
FIG. 8 is a block diagram of the signal flow and processing used to control operation of the vehicle restraint apparatus.

The block diagram, FIG. 8, summarizes the signal flow between the various elements of the vehicle restraint apparatus. The linear actuator 56 moves extensible shaft 55 by means of motor 60 which is an integral part of the actuator 56. The position of extensible shaft 55 determines the position of the wheel restraint lever 49 between being flush with the deck 13 and inclined 45 degrees with respect to the deck. The total travel of the extensible shaft 55 is set by the actuator retract limit switch 65 and the extend limit switch 66, which limit switch outputs appear on lines 67 and 68, respectively, to signal processor - controller 69 and the output signal 70 to actuator motor 60. The signal processor-controller 69 also provides signals which operate the red 64, amber 75, and green light 63 on the light assembly 62.

The infrared emitter 71 is positioned with respect to photoelectric switch 72 such that the output on line 73 is at null when there is no blockage of the infrared beam. The photoelectric switch 72 is mounted on fixed barrier 52 as shown in FIG. 7. Beam blockage will first occur when the dotted depiction of the approaching vehicle wheel 50 is as shown in FIG. 7. A signal (dark-on) appears on line 73 when tire 51 on the front wheel blocks the infrared beam 74 from entering the photoelectric switch 72. The amber light 75 on light assembly 62 will be illuminated when the "dark-on" signal on line 73 enters the processor-controller 69 at a time when extensible shaft 55 is not in its fully extended position as determined by limit switch 66 on the actuator 56. The "dark-on" signal on line 73 will initiate movement of shaft 55 to position the wheel restraint lever 49 from its flush deck configuration 61 to its 45 degree contact configuration at wheel contact 54. Movement will continue until the extend limit switch 66 is actuated, at which time the actuator will stop and the red light 64 on light assembly 62 win illuminate and the amber light 75 will extinguish.

When it is desired to exit the inclined deck, release of the restraint apparatus is initiated by the driver-operated switch 76, located in the cab of the vehicle. Operation of switch 76 transmits a radio frequency signal 77 to antenna 78 on the controller 69 for a suitable period of time. This action will cause the "dark-on" signal on line 73 to revert to null even though the infrared beam 74 is still blocked by wheel tire 51. During the suitable time interval the wheel restraint lever will be moved to its deck flush position 61 as shown in FIG. 7, at which time the green light 63 will illuminate and the red light 64 wig extinguish, giving the driver positive guidance to exit the inclined deck smoothly and without hinderance.

While the invention has been described in its preferred embodiment, it is to be understood that the words that have been used are words of description rather than limitation and that changes may be made within the purview of the appended claims without departing from the true scope and spirit of the invention in its broad aspects. For example, the force sensor described herein is not limited to measuring tension forces in round structural members but can be used to measure compression and tension in structural members of uniform cross-sectional area. The force sensor can utilize an electrical inductance measuring device in lieu of the mechanical dial indicator. A driver-accessible switch located out-side the vehicle can be used in lieu of the radio frequency transmission to initiate retraction of the vehicle restraining mechanism when it is desired to exit the drive deck. It should also be noted that the logic circuitry of the vehicle restraint system can be used for other purposes such as indicating when a parking position is occupied or available for use. Also, hydraulic actuators can be used instead of the cable systems described in the preferred embodiment.

I claim:

1. A structural fail-safe support system for storing vehicles comprising:

a stationary structure supported by the ground, an inclinable rigid structure supported by said stationary structure, a two-bearing axle on said stationary structure providing a pivot for said inclinable rigid structure, which does not change shape when tilted, two parallel independent means to rotate said inclinable rigid structure about the said axle on the said stationary structure providing a fail- safe characteristic if one of the said independent means should fail, two parallel rectangular upper and lower decks on said inclinable rigid structure, a compression member which connects the center of the full span of the said upper deck with the center of the full span of the said lower deck dividing the two said full spans into four smaller spans which can support a greater total load, two tension members which connect the bottom of the said compression member to the front left and right corners of the said upper deck to provide compression forces on the said bearings of the said axle on the said stationary structure, two tension members which connect the bottom of the said central compression member to the left and right rear corners of the said upper deck to provide reaction forces for said two means which rotate the said inclinable rigid structure, means to measure the forces on each of the four said tension members, means to adjust the forces on each said tension member to values which constrain the said compression member from deflecting when the said upper and lower decks are subjected to loads, a calibration procedure to equalize the reaction forces on the two said axle bearings and the two said inclinable rigid structure rotation means, a secondary lift system to counteract the empty weight of the said inclinable structure, eliminating the load of the said empty weight from the primary said independent means for rotating the said inclinable structure, and an automatic apparatus for restraining the motion of a stored vehicle on the said inclinable deck.

2. Apparatus as set forth in claim 1, further comprising two cable systems as the said independent means for rotating the said inclinable structure, said cable systems comprising an electric motor, power-off brake, double output shaft gear reducer, two independent cable drums, two cable hoist sheaves and two cable tension adjusters.

3. Apparatus as set forth in claim 1, further comprising an apparatus for measuring the said force on the said tension member by means of two yokes attached to the said tension member a specified distance apart along the said tension member when the said member is not under tension and a dimension dial indicator to read out variations of the said distance between said yokes when the tension member is subjected to external force.

4. Apparatus as set forth in claim 1, whereby the said secondary lift system comprises a counterweight equal to one quarter ($\frac{1}{4}$) the empty weight of the said inclinable structure, such counterweight supported by two cables which operate in parallel with the said primary lift system using a pair of two-groove pulleys and a pair of two-groove hoist sheaves.

5. Apparatus as set forth in claim 1, where the said automatic vehicle restraining means comprises:

a barrier means forwardly mounted on said inclinable deck for blocking a forward portion of a wheel of said vehicle, lever arm means comprising first and second angularly disposed and fixedly coupled members, such lever arm means pivotedly coupled to said inclinable deck and rearwardly mounted for engaging said first member with a rear portion of said wheel, said lever arm means and said barrier means cooperating to engage and restrain said wheel and said vehicle when said lever arm means is pivotedly actuated, linear actuator means comprising a housing having an end mounted to said deck and an extensible shaft pivotedly engaging said second member of said lever arm means such that selectable extension and counteraction of said extensible shaft causes rotation of said lever arm means about said inclinable deck pivot, wherein extension of said shaft results in engagement of said first member of said lever arm means with said wheel and contraction of said shaft results in disengagement of said first member from said wheel, said first member being recessed within said inclinable deck when said shaft is contracted, switch means coupled to said extensible shaft and responsive to a position thereof, indicator means coupled to said switch means and responsive to said selectable extension and contraction of said extensible shaft, a wheel position sensor for providing an indication that said wheel is abutting said barrier means, said position sensor means comprising an infrared emitter and a photoelectric switch, control means responsive to said wheel position sensor for initiating rotation of said lever arm in cooperation with a predetermined position of said wheel in substantially a restrained position, said switch means being comprised of first and second switch means, said first switch means being adapted for indicating that said lever arm is positioned to a first predetermined limit, and coupled to said indicator means for signaling that said vehicle shall be advanced to the restrained position, said switch means being adapted for indicating that said lever arm is positioned at a second predetermined limit so that said wheel is captured by said lever means and said bonier means in a restrained position, and apparatus comprising a third switch means for overriding said position sensor means and initiating rotation of said lever arm to allow release of said vehicle from the restrained position.

* * * * *